US008570622B2

(12) United States Patent
Pellaton et al.

(10) Patent No.: US 8,570,622 B2
(45) Date of Patent: Oct. 29, 2013

(54) METHOD OF MONITORING A SEQUENCE OF DOCUMENTS

(75) Inventors: Cyril Pellaton, Colombier (CH); Marco Bart, Berne (CH); Giuseppe Acunto, Fribourg (CH); Michael Enz, Berne (CH)

(73) Assignee: De la Rue International Limited, Hampshire (GB)

( * ) Notice: Subject to any disclaimer, the term of this patent is extended or adjusted under 35 U.S.C. 154(b) by 995 days.

(21) Appl. No.: 12/448,728

(22) PCT Filed: Jan. 4, 2008

(86) PCT No.: PCT/GB2008/000006

§ 371 (c)(1),
(2), (4) Date: Nov. 5, 2009

(87) PCT Pub. No.: WO2008/081183

PCT Pub. Date: Jul. 10, 2008

(65) Prior Publication Data

US 2010/0073711 A1 Mar. 25, 2010

Related U.S. Application Data

(60) Provisional application No. 60/878,691, filed on Jan. 5, 2007.

(51) Int. Cl.
*H04N 1/04* (2006.01)

(52) U.S. Cl.
USPC ..... 358/498; 358/474; 358/497; 358/486; 358/504; 271/303; 271/264; 271/3.14; 271/10.09; 271/278; 399/367; 73/649; 73/587; 73/620; 73/625

(58) Field of Classification Search
USPC ..... 271/258.01, 303, 264, 3.14, 14.01, 271/10.09, 278; 358/498, 474, 497, 486, 358/504; 399/367; 73/649, 587, 620, 625
See application file for complete search history.

(56) References Cited

U.S. PATENT DOCUMENTS 4,201,093 A * 5/1980 Logan ..... 73/618
4,406,996 A * 9/1983 Oka ..... 340/674

(Continued)

FOREIGN PATENT DOCUMENTS

EP 0 921 083 A2 6/1999
EP 1 510 484 3/2005

(Continued)

*Primary Examiner* — Twyler Haskins
*Assistant Examiner* — Dennis Dicker
(74) *Attorney, Agent, or Firm* — Oliff & Berridge, PLC

(57) ABSTRACT

A method of monitoring a sequence of documents passing along a transport path is described. The method including: operating a radiation transmitter with a control signal at a first, working, level to cause radiation at a first intensity to impinge on one side of a document as it passes an inspection position in the transport path; receiving at a radiation receiver, radiation from the transmitter that has passed through the document, the radiation receiver generating an output signal with a level related to the intensity of the received radiation; and monitoring the output signal to detect the presence and/or a characteristic of the document. A calibration process is carried out between successive documents, the calibration process including: operating the radiation transmitter with a control signal at a second, calibration, level to cause radiation at a second intensity less than the first intensity to be transmitted towards the receiver, and adjusting the level of the resultant output signal from the receiver to a predetermined value.

11 Claims, 10 Drawing Sheets

(56) References Cited

U.S. PATENT DOCUMENTS

| | | | | |
|---|---|---|---|---|
| 4,763,927 | A * | 8/1988 | Schneider | 283/70 |
| 4,785,295 | A | 11/1988 | Fukui et al. | |
| 5,067,704 | A | 11/1991 | Tsuihiji et al. | |
| 5,071,113 | A * | 12/1991 | Nakamura et al. | 271/267 |
| 5,153,859 | A * | 10/1992 | Chatigny et al. | 367/140 |
| 5,508,546 | A * | 4/1996 | Zalameda et al. | 250/338.3 |
| 5,565,627 | A * | 10/1996 | Dorr | 73/599 |
| 5,691,474 | A * | 11/1997 | Gerz | 73/580 |
| 6,082,732 | A * | 7/2000 | Hutchison et al. | 271/265.04 |
| 6,371,924 | B1 * | 4/2002 | Stearns | 600/528 |
| 6,392,330 | B1 * | 5/2002 | Zloter et al. | 310/334 |
| 6,411,015 | B1 * | 6/2002 | Toda | 310/334 |
| 6,502,928 | B1 * | 1/2003 | Shimada et al. | 347/68 |
| 6,868,135 | B1 * | 3/2005 | Phinney et al. | 375/371 |
| 6,898,135 | B2 * | 5/2005 | Asano et al. | 365/205 |
| 6,970,235 | B2 * | 11/2005 | Christophersen | 356/71 |
| 7,223,243 | B2 * | 5/2007 | Morris et al. | 600/459 |
| 7,654,521 | B2 * | 2/2010 | Simonis et al. | 271/262 |
| 7,748,274 | B2 * | 7/2010 | Pellaton et al. | 73/649 |
| 8,045,868 | B2 * | 10/2011 | Kuramochi et al. | 399/45 |
| 8,066,280 | B2 * | 11/2011 | Simonis et al. | 271/262 |
| 2002/0036446 | A1 * | 3/2002 | Toda et al. | 310/328 |
| 2004/0150155 | A1 * | 8/2004 | Okitsu et al. | 271/262 |
| 2005/0012259 | A1 * | 1/2005 | Sano et al. | 271/10.01 |
| 2005/0150740 | A1 * | 7/2005 | Finkenzeller et al. | 194/207 |
| 2009/0050826 | A1 * | 2/2009 | Schoen | 250/559.4 |

FOREIGN PATENT DOCUMENTS

| | | |
|---|---|---|
| GB | 2 165 045 A | 4/1986 |
| WO | WO 92/17857 | 10/1992 |
| WO | WO 00/42477 | 7/2000 |

* cited by examiner

Fig.5.

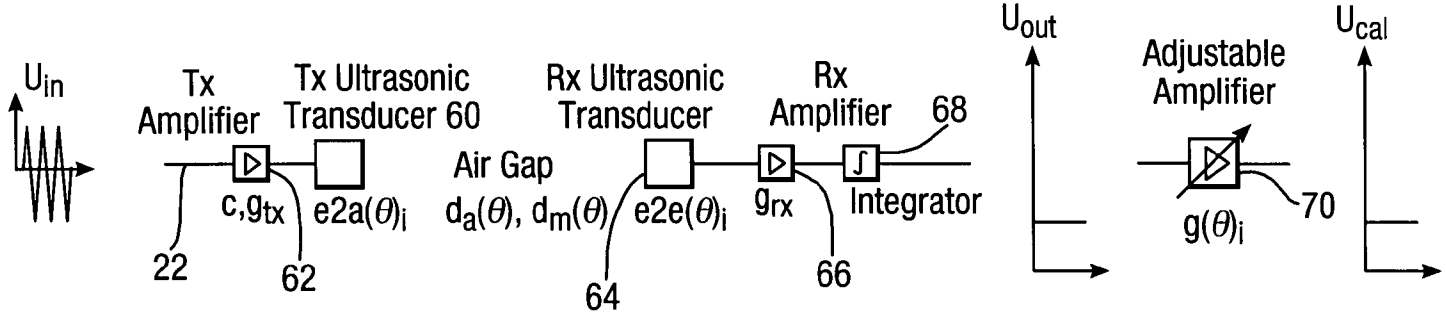

$$U_{cal(i)} = MAX(\hat{U}_{in} * c_n * g_{tx} * e2a(\theta)_i * d(\theta)_a * d(\theta)_m * a2e(\theta)_i * g_{rx}, v_{max}) * 1/\sqrt{2} * g(\theta)_i$$

| | |
|---|---|
| $U_{cal(i)}$ | Channel-specific, calibrated DC output voltage. |
| $\hat{U}_{in}$ | Input AC amplitude 300kHz (global). |
| $c * g_{tx}$ | Tx gain (global, $g_{tx}$ = constant, c can be zero or one of four pre-defined factors $c_1 \ldots c_4$). |
| $e2a(\theta)_i$ | Channel-specific electric-to-ultrasonic conversion factor (temperature dependent). |
| $d_a(\theta)$ | Dampening of the ultrasonic signal in the air gap (global, temperature dependent). |
| $d_m(\theta)$ | Dampening of the ultrasonic signal by an obstacle in the air gap (global, temperature dependent). |
| $a2e(\theta)_i$ | Channel-specific ultrasonic-to-electric conversion factor (temperature dependent). |
| $g_{rx}$ | Tx gain (global, fixed). |
| $1/\sqrt{2}$ | Conversion factor from AC amplitude to RMS (represents the integrator element). |
| $g(\theta)_i$ | Channel-specific calibration gain factor (temperature dependent). |
| $v_{max}$ | Maximum output amplitude of the Rx amplifier. |

METHOD OF MONITORING A SEQUENCE OF DOCUMENTS

FIELD OF THE INVENTION

The invention relates to a method of monitoring a sequence of documents passing along a transport path. The invention is particularly concerned with the monitoring of security documents such as banknotes, cheques and the like but could also be used for monitoring other types of document.

PRIOR ART

In a conventional document monitoring system, one inspection technique which is commonly used is to cause a beam of radiation to pass through each document so as to monitor the attenuation of the radiation beam. This attenuation is related to the thickness of the document and can be used to detect the presence of overlapped or double fed documents which is usually undesirable. Once such an overlapped condition has been detected then the documents can be routed to a cull pocket or the like. In some cases, however, particularly where the documents are to be counted, even the overlapped documents could be validly counted. A example of this type of device is described in WO-A-00/42477.

An important aspect of this type of monitoring device is that it must be calibrated in order to ensure that a preset detection level at the receiver monitoring when the transmitted radiation is sufficiently attenuated to correspond to the passage of one or more documents, is not affected by soiling etc. Conventionally, calibration is achieved by placing a dampening film between the transmitter and the receiver while the transmitter is operated at full power. The received power level is noted and if necessary an adjustment can be made to either the full power supplied to the transmitter or to the gain used at the receiver. The dampening film is then removed and documents can be processed.

An important variable which it has been found needs to be taken into account, particularly with ultrasonic transmitters, is the effect of temperature changes. These can cause the intensity of the emitted radiation to change for a given control signal input. U.S. Pat. No. 4,406,996 describes an optical detection device which attempts to avoid the problems of temperature changes as well as the presence of dust and the like. In this system, before any documents are fed, the transmitter is activated at full power level and then the power level is gradually decreased until the received intensity reaches a preset threshold. The system is then ready for operation.

We have found, however, that in the high speed handling of documents such as banknotes, typically at speeds of 6-8 notes per second, the temperature within the device can vary significantly even during the processing of a single batch of 100 documents. The process of U.S. Pat. No. 4,406,996 is not able to deal with this rapid temperature variation.

EP-A-0921083 describes another example of an optical detection device. Initially, when no note is present between the lamp and sensor, the lamp generates illumination at an initial brightness well below its maximum level. The brightness is then adjusted until the output from the sensor is maximised. The drawback of this approach is that it is necessary to control the lamp intensity as part of the calibration process.

WO-A-92/17857 describes yet another optical detector in which groups of LEDs are provided on one side of a document path while strip photodiodes are provided on the other side. The LEDs are energised sequentially. The output level from each LED is the same during both calibration and note detection and during calibration the gain of an amplifier connected to the LEDs is adjusted so that its output is constant in the absence of a document.

GB-A-2165045 discloses a further optical detector in which a light source is energised at a constant level and the output from the sensor, fed through an amplifier, is monitored and the gain of the amplifier adjusted occasionally if during the calibration phase it falls below a reference level.

One of the difficulties with these approaches is that the sensor needs to be sensitive to relatively low radiation levels when a document is present but during calibration, when no document is present, the sensor is exposed to the full power of the source of radiation.

SUMMARY OF THE INVENTION

In accordance with the present invention, a method of monitoring a sequence of documents passing along a transport path comprises:

operating a radiation transmitter with a control signal at a first, working, level to cause radiation at a first intensity to impinge on one side of a document as it passes an inspection position in the transport path;

receiving, at a radiation receiver, radiation from the transmitter that has passed through the document, the radiation receiver generating an output signal with a level related to the intensity of the received radiation; and monitoring the output signal to detect the presence and/or a characteristic of the document;

and is characterised by carrying out a calibration process during the passage of documents along the transport path and when a gap between documents exists at the inspection position, the calibration process comprising operating the radiation transmitter with a control signal at a second, calibration, level to cause radiation at a second intensity less than the first intensity to be transmitted towards the receiver, and adjusting the level of the resultant output signal from the receiver to a predetermined value.

With this invention, we overcome the problems mentioned above by operating the radiation transmitter at two very different levels. This enables the output level from the receiver, typically controlled by controlling the gain of an amplifier, to be adjusted during the calibration phase in response to a relatively low level of radiation (the calibration level) instead of utilizing the higher intensity of radiation (the working level) where any amplifier would typically saturate. Thus, the invention provides a simple two level control to the radiation transmitter and deals with fine adjustment of the receiver by suitably adjusting the output signal from the receiver.

In a typical example, the resultant output signal during calibration or when a document is present and thus absorbing a substantial proportion of the working level intensity radiation will be in the order of 100 microvolts. Where the receiver includes an amplifier, typical amplifiers will saturate at 400 microvolts. Thus, during calibration, a typical calibration level control signal will have a voltage of 200 mV peak to peak whereas the corresponding working level will be 20V. In general, the magnitude of the first, working level will be at least 10 times the magnitude of the second, calibration level.

More generally, the second, calibration level of the control signal will be up to about 500 times less than the first, working level of the control signal. This simulates the level of the signal received by the receiver in the presence of a document.

In addition, in this new method, we calibrate the transmitter/receiver pair during the passage of the documents. This may be between the passage of each document or group of documents. This ensures that even rapid temperature variations are compensated. Furthermore, the particular way of achieving that calibration enables the process to be carried out between documents or groups of documents even though they may be fed at high speed. That is, the calibration process requires the simple switching of a control signal between its working and calibration levels and this should be contrasted with the process described in U.S. Pat. No. 4,406,996 which requires a sequential stepping of the output power of the transmitter from its full power level down to the preset level. This would take too long to carry out between successively fed documents at the feed rates contemplated. Typically, the calibration process will take 200 μs-1 ms while the time between successive banknotes of conventional dimensions fed at 6-8 notes per second, long edge leading is of the order of 50 ms.

Although the invention is applicable to a single radiation transmitter/receiver pair, preferably a plurality of transmitter/receiver pairs are provided, wherein the calibration process comprises controlling all the transmitters with the control signals at the same calibration level, and adjusting the signals output by the receivers to the same predetermined value.

The plurality of transmitter/receiver pairs will typically be provided in a line transverse, typically orthogonal, to the direction of the transport path. This enables characteristics of the documents to be detected at different positions across the transport path.

In addition to carrying out the calibration process between successive documents, the process may also be carried out before documents begin to be fed along the transport path, so as to achieve an initial calibration.

The control and output signals will typically comprise a voltage or a current level depending upon the way in which the transmitter is operated and the receiver configured.

The invention is primarily concerned with radiation in the ultrasound frequency range typically in the range 40 kHz-1 MHz, particularly 300 kHz, but is also applicable to radiation in other wavelength bands, particularly optical, infrared and ultraviolet.

Other information can be obtained from the radiation transmitter/receiver pair. For example, a gap between successive documents can be detected when the receiver detects radiation at the first intensity. Alternatively, gaps between successive documents can be detected using other methods such as an optical detector or simply by predicting when a gap is expected knowing the speed at which documents are transported along the transport path.

The presence of a document can be detected when a control signal at the second, calibration level is applied to the transmitter and the corresponding receiver receives substantially no radiation.

In some cases, it is advantageous if the or each transmitter is controlled with a control signal set at a level less than the first, working level, such as the calibration level, as long as the radiation from that transmitter does not impinge on a document. In the event of a document arriving, the intensity of the ultrasound received at the receivers will decrease substantially to zero and the first scan line of the documents surface will be lost, but thereafter the transmitter will be operated by a control signal at the working level. As the height (i.e. length in the transport direction) of a scan line is small compared to the height of a document, the loss of data for a single line will be negligible.

The method can be used to detect the thickness of each document as it passes the inspection position as well as folded, or overlapped documents. In addition, or alternatively, other characteristics of the documents could be detected such as the presence of tapes, closed and open tears and the like.

The invention is particularly applicable to the processing of documents of value such as banknotes but could be used for monitoring the passage of other documents as will be readily apparent to a person of ordinary skill in the art.

BRIEF DESCRIPTION OF THE DRAWINGS

An example of a document inspection apparatus for carrying out a method according to the present invention will now be described with reference to the accompanying drawings, in which:

FIG. 5 illustrates a signal path model for a transmit and receive ultrasonic transducer pair;

DETAILED DESCRIPTION OF EMBODIMENTS

Figure 1A:
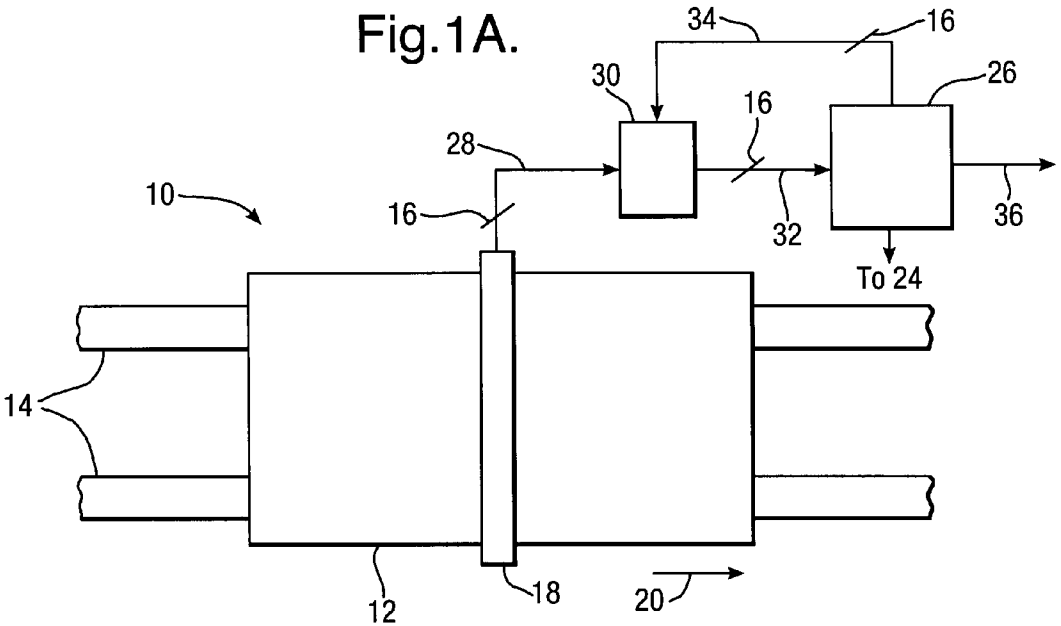
FIGS. 1A and 1B are schematic plan and side elevations of a document inspection station forming part of the document handling apparatus.
Figure 1B:
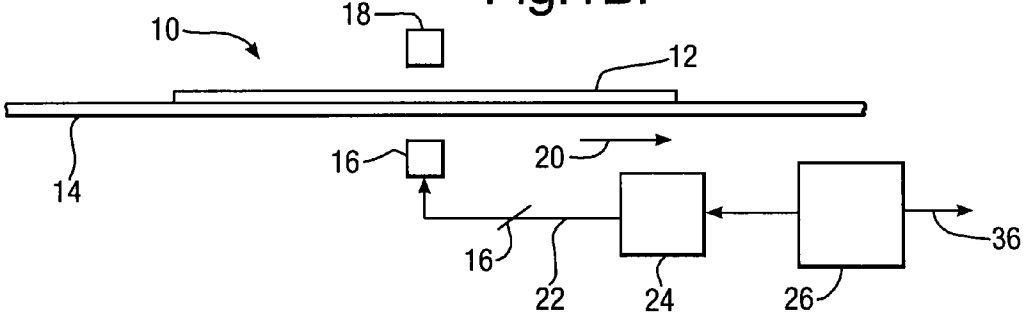

The document handling apparatus shown in FIGS. 1A and 1B will be described with reference to a banknote receiving device although the invention is applicable to other types of banknote handling equipment such as banknote sorters and recyclers. The apparatus includes an inspection station 10 (FIGS. 1A and 1B) through which banknotes 12 are fed as a result of being conveyed by a pair of conveyor belts 14.

The inspection station 10 comprises an array of 16 ultrasonic transmitting transducers 16 located below the transport path and a corresponding array of 16 ultrasonic receiving transducers 18 located above the transport path and positioned such that each ultrasonic receiver is located directly opposite a corresponding ultrasonic transmitter. The two arrays 16, 18 extend orthogonally to the direction of movement of the banknotes as indicated by an arrow 20. It would also be possible for the arrays 16,18 to extend in a non-orthogonal direction across the transport path.

Suitable transducers are manufactured by Murata under the product name MA300D1.

Each ultrasonic transmitting transducer 16 is controlled by control signals fed along respective control lines 22 from front end electronics 24. The front end electronics 24 are in turn controlled from a suitably programmed computer 26.

Each ultrasonic receiving transducer in the array 18 is connected via a respective output line 28 to signal conditioning electronics 30 including an adjustable gain amplifier (not shown in FIG. 1A), the output of which is digitized and then fed along a respective output line 32 to the computer 26. The computer 26 generates gain adjustment signals in the manner to be described below, these gain adjustment signals being fed along respective lines 34 to the conditioning electronics 30. Other processing arrangements are possible to implement these functions as will be readily understood by a person of ordinary skill in the art. For example, the adjustable gain amplifier could be a distinct component or form part of the computer 26 in the form of a digital signal processor.

Hereafter, a transmitting transducer and associated electronics will be referred to as a transmitter while a receiving transducer and associated electronics will be referred to as a receiver.

The computer 26 also outputs signals on a line 36 relating to the characteristics of banknotes 12 which have been monitored in the inspection station.

Figure 2:
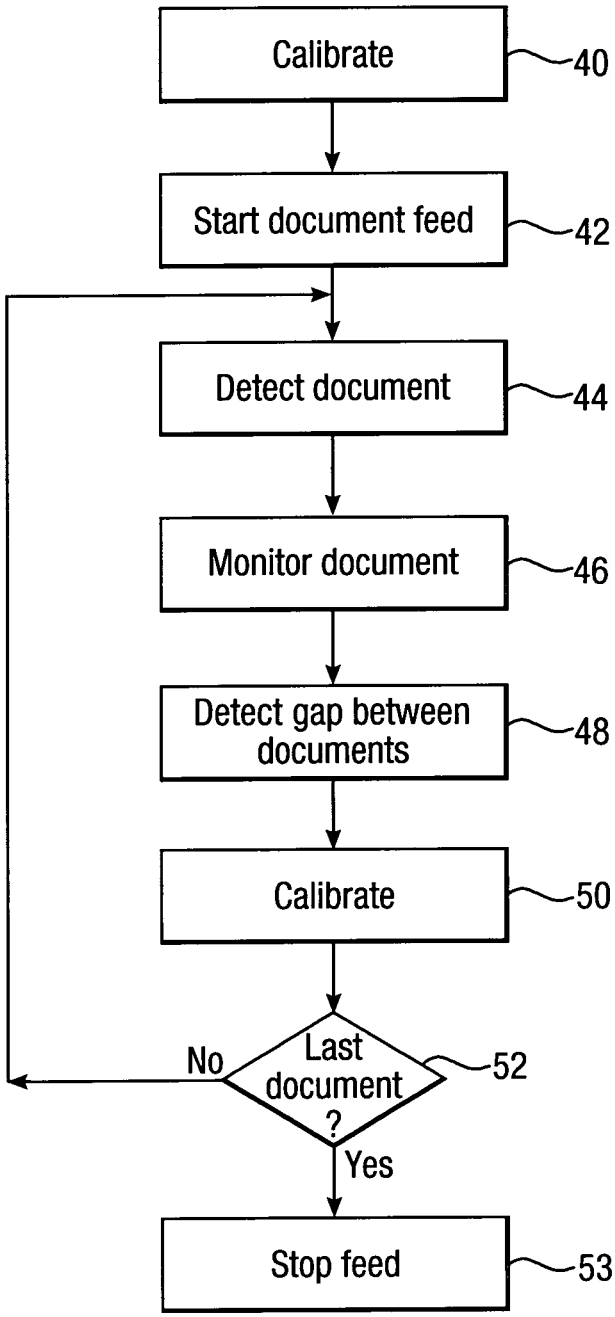
FIG. 2 is a flow diagram illustrating operation of the document thickness monitoring components.

The process undertaken by the components at the inspection station will now be described with reference to FIGS. 1*a*, 1*b* and 2. Initially, before a batch of banknotes 12 is transported by the transport system through the inspection station, a calibration operation will be carried out (step 40, FIG. 2) to be described in more detail below. Once the calibration process has been carried out, the transport system will be activated and the first document 12 will be fed by the conveyor belts 14 to and through the inspection station 10 (step 42).

Once activated, the transmitters 16 are repeatedly activated in groups of odd and even numbered transmitters (to reduce the risk of cross-talk) at the low, calibration level (to be described in more detail below). This is achieved by providing appropriate voltage control signals at the "calibration" level to the appropriate transmitters. Alternatively, the transmitters could be controlled by controlling the current supply but account must be taken of the fact that output intensity does not vary directly with current amplitude.

When a document arrives at the inspection station 10, the intensity of ultrasound received at the receivers 18 will decrease substantially to zero allowing the computer 26 to determine that the document has arrived (step 44).

The computer 26 then adjusts the control signals to the transmitter 16 to their high "working" level and again sequentially pulses the transmitters in their odd and even groups. The document will then be monitored (step 46) as described in more detail below.

During the passage of a document 12 between the transmitters and receivers 16, 18, the intensity of the transmitted ultrasonic signal will be attenuated but when the ultrasound is transmitted through a gap between documents then the received intensity will increase substantially. The computer 26 detects this increase in intensity to determine the presence of a gap (step 48).

While a gap between documents is present, the computer 26 controls the components to carry out a further calibration operation (step 50).

The computer 26 then determines whether the banknote 12 just monitored is the last banknote in the batch. This may be determined if it is known in advance how many banknotes are to be transported or, for example, if the time between completion of monitoring a banknote and the time at which the next banknote is expected is exceeded (step 52).

If the document just monitored is not the last document then processing returns to step 44 but otherwise the transport is stopped (step 53).

Figure 4:
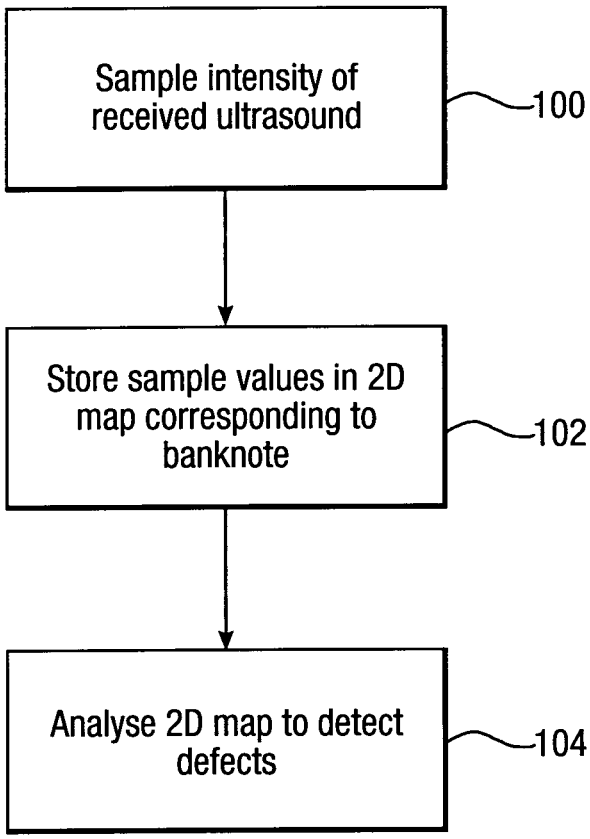
FIG. 4 is a flow diagram illustrating the processing of intensity signals during the passage of a document through the inspection station.

When a document 12 is being monitored (step 46) as it passes through the inspection station 10, the output signals from the ultrasonic receivers in the array 18 are regularly sampled (step 100, FIG. 4) so as to build up (step 102) a map of the apparent opacity to ultrasonic radiation of different pixels of the banknote and this can then be used to determine characteristics about the banknotes such as the presence of a tape, tears, folds and overlapped banknotes and the like (step 104), for example by determining that certain groups of pixels attenuate the ultrasound by more than a certain threshold. Depending upon the result of that comparison, the computer 26 will issue a suitable output signal on the line 36 which can be used to control further processing of the note in a conventional manner.

Figure 3:
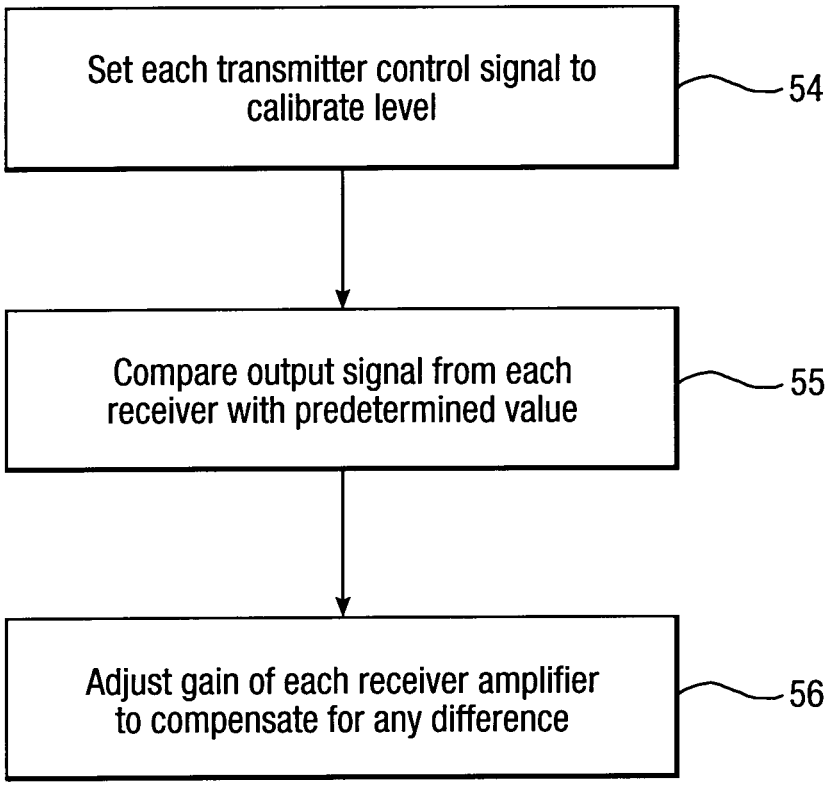
FIG. 3 is a flow diagram illustrating the calibration process of FIG. 2.

Briefly, the calibration process carried out in steps 40 and 50 is set out in FIG. 3. During this calibration process, the voltage control signal transmitted along the lines 22 is set to pulse the transmitters successively in odd and even groups at a calibration level (step 54) which is lower, usually by about 100 times (e.g. 200 mV), than the voltage (e.g. 20V) of the control signal used when monitoring banknotes such that the intensity of the resultant ultrasound signal transmitted by each transmitter of the array 16 is about 100 times less than its working level. In other cases, the calibration level could be up to 500 times less than the working level.

The output signal then generated by each ultrasonic receiver is compared by the computer 26 with a common predetermined value (step 55) and the computer then calculates an adjustment that needs to be made to the gain of the adjustable gain amplifier corresponding to each ultrasonic receiver so as to modify the resultant output signal fed to the computer 26 to take up the predetermined value (step 56).

As a result of this calibration process, it is anticipated that for a given thickness of banknote, the output signal generated from the adjustable gain amplifier corresponding to each ultrasonic receiver will be substantially the same thus allowing a simple comparison with a predetermined common threshold corresponding to the expected signal from an intact, single banknote.

The signal generation and processing will now be described in more detail. FIG. 5 provides a simplified model of one ultrasonic transmit and receive transducer pair. As can be seen, the transmit ultrasonic transducer 60 receives a control signal having a voltage $U_{in}$ on the line 22 via a transmit amplifier 62. The resultant ultrasonic signal is transmitted across the note path and is received by a receive ultrasonic transducer 64 which generates a corresponding output signal with a voltage which varies with sensed ultrasonic intensity and which is amplified by a receive amplifier 66 and then integrated by integrator 68 before being fed to an adjustable gain amplifier 70. The components 66, 68, 70 are located in the processing electronics 30. The effect of the adjustable gain amplifier 70 is to adjust the level of the signal output from the integrator to a calibrated value.

As explained earlier, the system in fact has 16 independent channels, which all possess a signal path according to the above description. The gain factors of the corresponding adjustable amplifiers 70 can be set independently while all other amplifiers will be assigned a type-specific mutual constant (i.e. $g_{tx}$ and $g_{rx}$).

This model is based on the assumption that multiplying $g_{tx}$ by a factor will multiply the received signal by the same factor. It reflects the temperature-dependency of the elements in or adjacent the acoustic section of the signal path by including a temperature parameter for the affected functions. A thorough description of all the temperature dependencies will be very complex but we believe the model set out above and shown in FIG. 5 is sufficient for the purpose of understanding and implementing this example of the invention.

As explained above, the calibration process involves three steps.

1. When the air gap between the transmitter 60 and the sensor 64 is unobstructed (e.g. before the batch processing starts or in the note gap), the output power level of the transmitter array is reduced ($c*g_{tx}$) by generating control signals at the low calibration level 61 (FIG. 6) (e.g. 200 mV), and the measured signal intensity on the receiver side stored for each channel. The resulting signal intensity on the receiver side is in this case approximately the same as is measured in working level mode with a banknote in the air gap (same operation point).

2. A gain correction factor for each channel (i) is computed according to the formula:

$$\text{gainFactor}(i)=\text{TargetLevelConstant}/\text{storedIntensityForChannel}(i)$$

Figure 6:
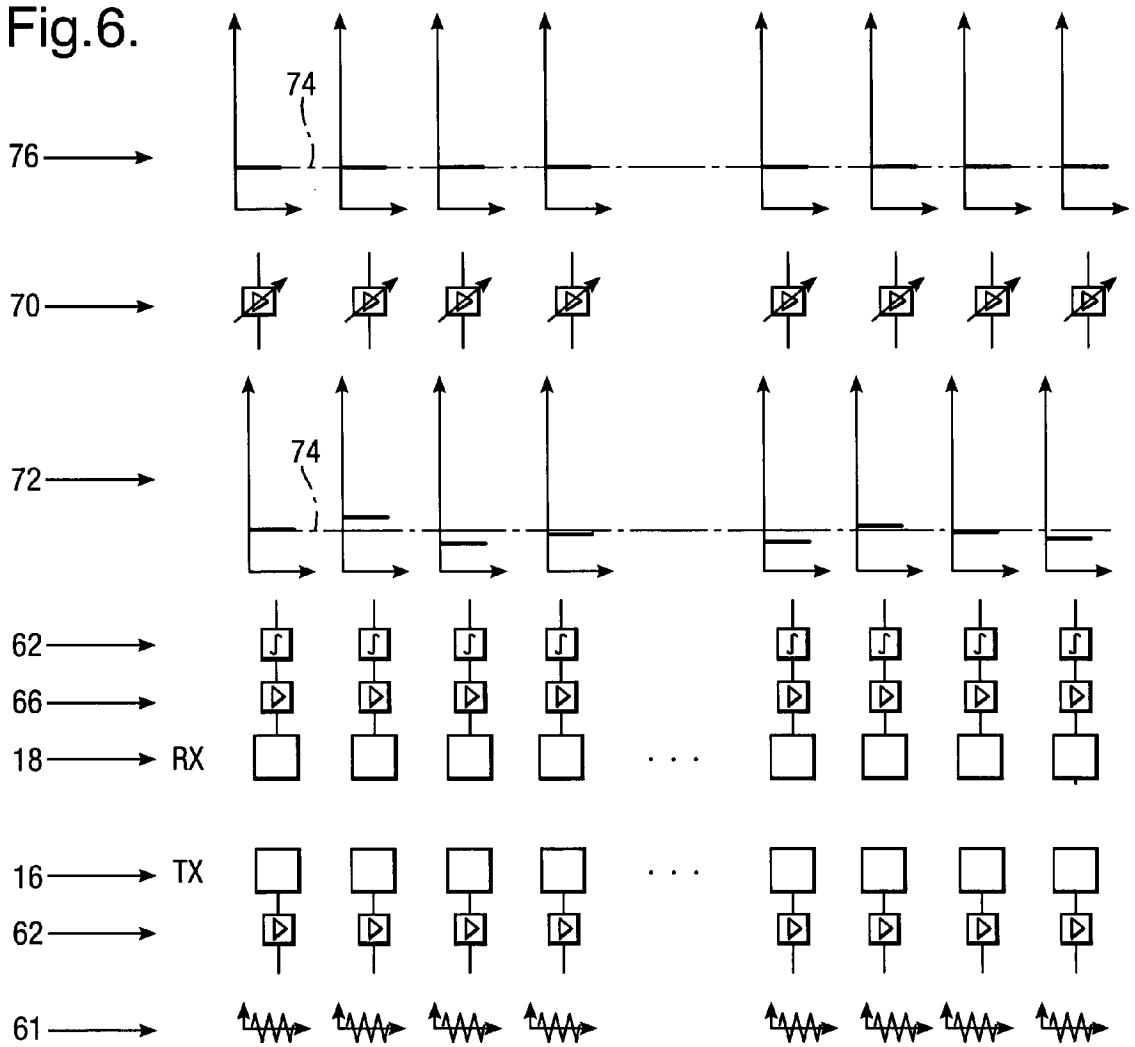
FIG. 6 illustrates schematically the signals obtained before and after compensation during the temperature compensation calibration process.

FIG. 6 illustrates schematically the process at this stage. The graphs 72 illustrate the output $U_{out}$ from each integrator 68 and it can be seen that these outputs vary relative to a mean output level 74. The adjustable gain amplifiers 70 are therefore adjusted by the computer 26 so that the final output from each adjustable gain amplifier 70 is at the same value 74 as shown by graphs 76.

In a modified approach, instead of computing the gain values solely based on data for the current note, the processing history could be taken into account. One possible implementation of this could be a moving average.

Before the transport starts, a background scan at calibration level is performed. The measured channel intensity mean values are used as seed for the moving average. In each note gap, the channel intensities are measured at calibration power level. The gains for correcting the image are then computed by updating the moving average with the just-measured note-gap intensities. This is repeated for all notes in the bundle being processed.

3. As the banknote arrives at the inspection station 10 (during note scanning), the transmitter array's output is reset to the working level (e.g. 20V) as described above. For each measurement point of the note surface (pixel of the ultrasonic image) the intensity is multiplied with the gain factor of the relevant channel:

$$\text{outputIntensity}(i)=\text{measuredIntensity}(i)*\text{gainFactor}(i)$$

Figure 7:
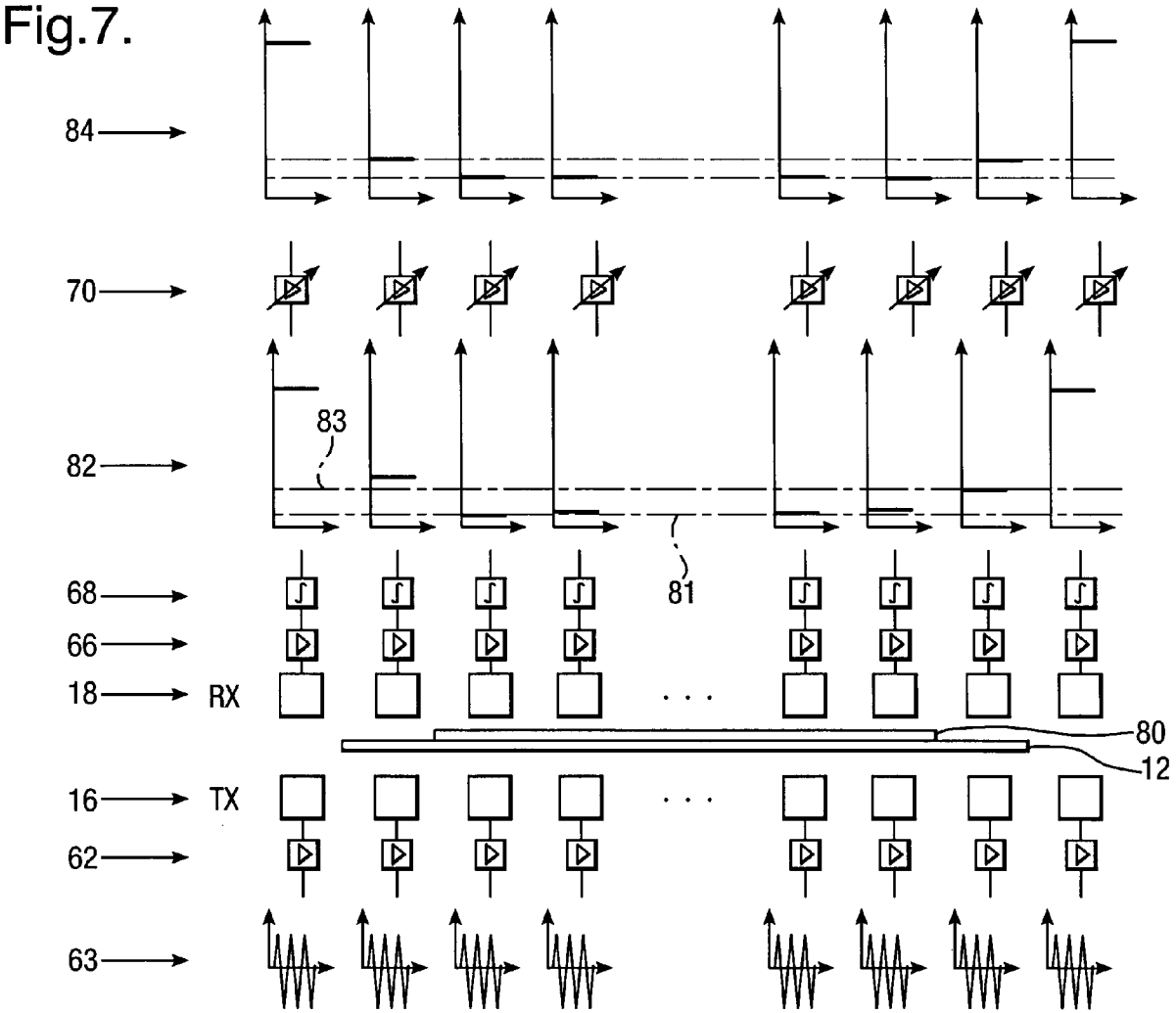
FIG. 7 illustrates the signals obtained before and after compensation during note scanning.

FIG. 7 illustrates the system and signals during note scanning. As can be seen, the control signals 63 applied to each transmitter in the array 16 are at the higher, working voltage level. In this case, the banknote 12 carries a length of tape 80 which will cause increased attenuation of the transmitted ultrasound. The effect of this can be seen in the graphs 82 where the received intensities from the outermost receivers is at a very high level because the path from the corresponding transmitters is unobstructed. For those receivers which receive ultrasound having been transmitted through both the banknote 12 and the tape 80, the received signal level is at a very low level about a mean 81 while the remaining receivers receive ultrasound radiation which has passed only through the banknote 12 generating outputs about a mean intermediate level 83. These output levels are then adjusted by the amplifiers 70 so that the output signal levels corresponding to each respective condition are the same as shown by graphs 84.

Figure 8:
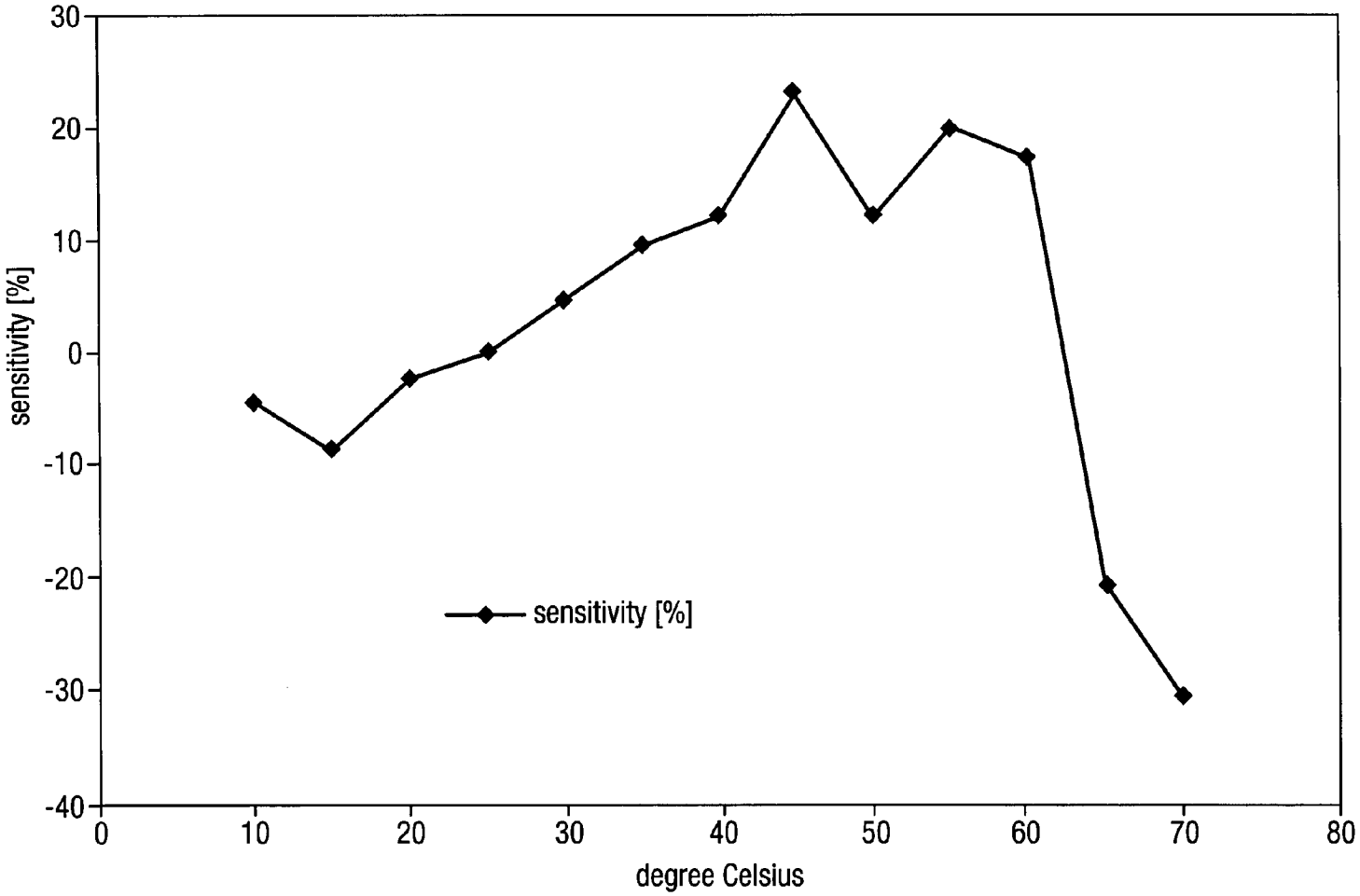
FIG. 8 illustrates the variation in sensitivity with temperature for a typical commercially available transducer.
Figure 9:
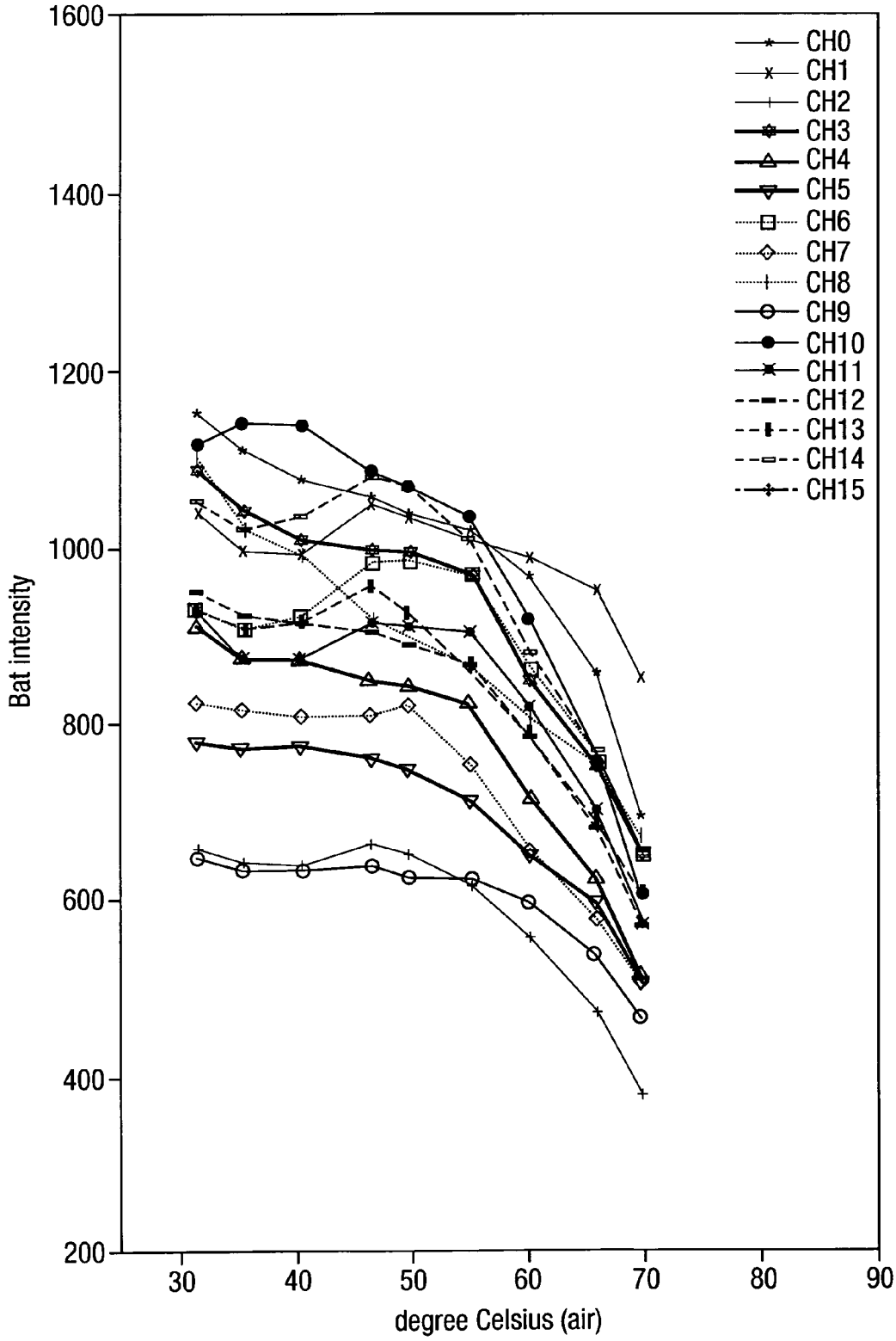
FIG. 9 illustrates the way in which the output signals from each of 16 ultrasonic transducers in an array varies depending upon the ambient temperature; and, FIG. 10 illustrates the variation in the output signal generated by the adjustable gain amplifiers after they have been calibrated.

As explained above, the transport of documents such as banknotes at high speed causes significant temperature variation within the apparatus and the transmit and receive transducers in the arrays 16,18 are susceptible to variation due to the temperature changes. FIG. 8 illustrates the variation in sensitivity with temperature for a typical commercially available transducer while FIG. 9 illustrates the way in which the output signals from each of 16 ultrasonic receivers in an array corresponding to the array 18 varies depending upon the ambient temperature. These signals correspond to those output from each integrator 68. In this case, the same control signal was applied to each transmitting transducer at all temperatures.

The problem with this variation is that the variation (or noise) exceeds variations expected during the passage of banknotes.

Figure 10:
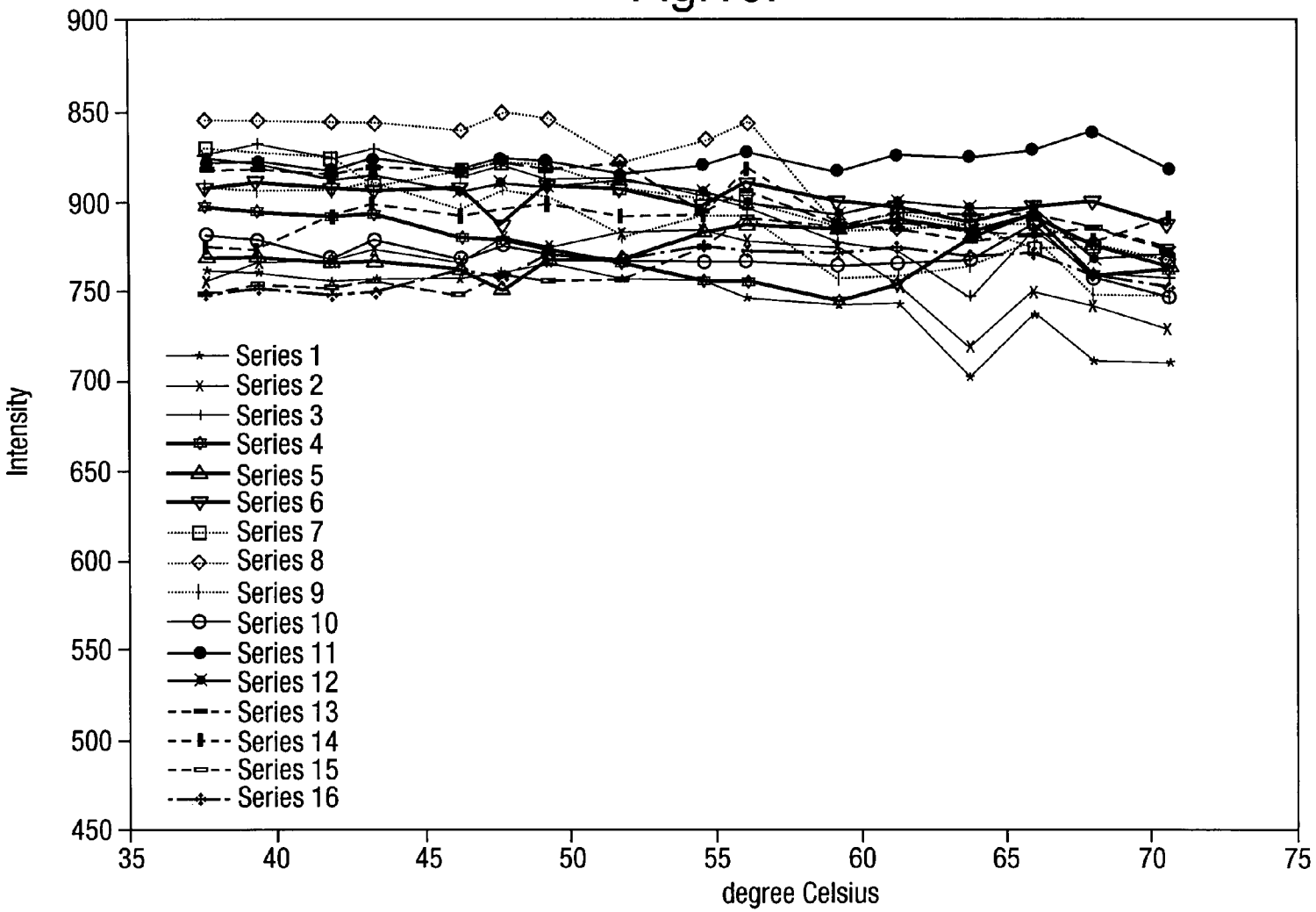

FIG. 10 illustrates the variation in the output signal generated by the adjustable gain amplifiers 70 after they have been calibrated for the same 16 receivers and it will be seen that the variation is much smaller than for the uncompensated signals.

The invention claimed is:

1. A method of monitoring a sequence of documents passing along a transport path, the method comprising:

operating a radiation transmitter with a control signal at a first, working, level to cause radiation at a first intensity to impinge on one side of a document as it passes an inspection position in the transport path;

receiving at a radiation receiver, radiation from the transmitter that has passed through the document, the radiation receiver generating an output signal with a level related to the intensity of the received radiation; and monitoring the output signal to detect the presence and/or a characteristic of the document;

carrying out a calibration process during the passage of documents along the transport path and when a gap between documents exists at the inspection position, the calibration process comprising operating the radiation transmitter with a control signal at a second, calibration, level to cause radiation at a second intensity less than the first intensity to be transmitted towards the receiver whereby the receiver generates a resultant output signal, and adjusting the level of the resultant output signal from the receiver to a predetermined value, the level of the resultant output signal from the receiver being adjusted by adjusting the amplification applied by an amplifier coupled to the output of the receiver, wherein the radiation comprises ultrasound.

2. A method according to claim 1, wherein a plurality of transmitter/receiver pairs are provided, wherein the calibration process comprises controlling all the transmitters with the control signals at the same calibration level, and adjusting the signals output by the receivers to the same predetermined value.

3. A method according to claim 1, wherein the calibration process is also carried out before documents begin to be fed along the transport path.

4. A method according to claim 1, wherein the signal level associated with the control and output signals comprises a voltage or current level.

5. A method according to claim 1, wherein the second, calibration level of the control signal is at least 100times, preferably up to 500times, less than the first, working level of the control signal.

6. A method according to claim 1, further comprising detecting a gap between successive documents when the receiver detects radiation at the first intensity.

7. A method according to claim 1, wherein a document is detected when a control signal at the second, calibration level is applied to the transmitter and the corresponding receiver receives substantially no radiation.

8. A method according to claim 1, wherein when the calibration process is not carried out, the or each transmitter is controlled with a control signal set at a level less than the first, working level, such as the calibration level, when radiation from that transmitter does not impinge on a document.

9. A method according to claim 1, wherein the calibration process is carried out between successive documents.

10. A method according to claim 1, wherein the documents comprise documents of value such as banknotes.

11. A method according to claim 1, wherein the characteristic of the document which is detected is its thickness.

* * * * *